US010962220B2

(12) United States Patent
Zhao et al.

(10) Patent No.: US 10,962,220 B2
(45) Date of Patent: Mar. 30, 2021

(54) FLAMELESS STEAM BOILER

(71) Applicant: Zhejiang Liju Boiler Co., Ltd., Hangzhou (CN)

(72) Inventors: Rongxin Zhao, Hangzhou (CN); Yongqiang Wang, Hangzhou (CN); Bingyuan Shen, Hangzhou (CN); Erpeng Qiu, Hangzhou (CN); Jian He, Hangzhou (CN); Huizhen Li, Hangzhou (CN); Jingyang Jin, Hangzhou (CN); Xiaoping Gao, Hangzhou (CN)

(73) Assignee: Zhejiang Liju Boiler Co., Ltd., Hangzhou (CN)

( * ) Notice: Subject to any disclaimer, the term of this patent is extended or adjusted under 35 U.S.C. 154(b) by 81 days.

(21) Appl. No.: 16/132,476

(22) Filed: Sep. 17, 2018

(65) Prior Publication Data

US 2019/0277491 A1 Sep. 12, 2019

Related U.S. Application Data

(63) Continuation-in-part of application No. 15/913,941, filed on Mar. 7, 2018, now Pat. No. 10,767,854.

(51) Int. Cl.
*F22B 31/04* (2006.01)
*F22B 21/14* (2006.01)

(52) U.S. Cl.
CPC ..... *F22B 31/04* (2013.01); *F22B 21/14* (2013.01)

(58) Field of Classification Search
CPC ..... F22B 31/04
See application file for complete search history.

(56) References Cited

U.S. PATENT DOCUMENTS 2,536,425 A * 1/1951 Daly ..... F24H 1/26 122/145
2,567,695 A * 9/1951 Cox ..... F22B 21/005 122/240.1
4,413,590 A * 11/1983 Landreau ..... F24H 7/0266 122/16.1
4,424,768 A * 1/1984 Testa ..... F24H 1/50 122/13.01

(Continued)

*Primary Examiner* — Nathaniel Herzfeld
(74) *Attorney, Agent, or Firm* — Kilpatrick Townsend & Stockton LLP

(57) ABSTRACT

Embodiments provide a combustion structure that can achieve stable combustion by addressing the aforementioned drawbacks in the prior art such as low flam stability, backfire, deflagration, blockage and/or any other drawbacks. The combustion chamber structure in accordance with the disclosure can include: a grate structure including a first set of elongated components, a fire retention structure including a second set of elongated components. The first set of first elongated components can be arranged along an axial direction within the combustion chamber structure. The second set of elongated components can be arranged along the axial direction in a same direction as the first elongated components. The second set of elongated components can be configured to generate a negative pressure zone within the combustion chamber. The first set of elongated components can form apertures that can be aligned with apertures formed by the second set of elongated components.

9 Claims, 7 Drawing Sheets

(56) References Cited

U.S. PATENT DOCUMENTS

| | | | | |
|---|---|---|---|---|
| 4,723,602 | A * | 2/1988 | Huigen | F28F 1/003 165/180 |
| 5,123,480 | A * | 6/1992 | Dixit | F28D 13/00 122/4 D |
| 7,972,581 | B1 * | 7/2011 | Tanaka | F23C 13/08 423/239.1 |
| 2008/0028949 | A1 * | 2/2008 | Schallig | A47J 31/54 99/323.3 |

* cited by examiner

FLAMELESS STEAM BOILER

CROSS-REFERENCE TO RELATED APPLICATION

This application is a continuation of U.S. application Ser. No. 15/913,941, filed on Mar. 7, 2018, the disclosure of which is hereby incorporated by reference in its entirety.

BACKGROUND OF THE INVENTION

Embodiments relate generally to steam boilers.

A steam boiler is a form of low water-content boiler. A conventional steam boiler includes a water tank for storing water, a water supply line supplying water to the water tank, a heater heating the stored water, a steam line supplying generated steam to an outside, and a thermal fuse preventing overheating of the heater.

In such a conventional steam boiler, the water in the boiler is usually directly heated by the flame generated by the combustion by the burner. In this way, the flue gas generated during the combustion may be quickly taken away as the exhaust gas. This can consume much heat. Since the flame combustion state is not controllable, combustion may not be complete in certain pockets of areas in the combustion zone. The incomplete combustion can cause harmful gases. In addition, heat generated by the combustion in the conventional steam boiler can have limited contact with the stored water. This can cause heat loss and inefficient energy use.

BRIEF SUMMARY OF THE INVENTION

In general, embodiments provide an improved steam boiler. The steam boiler comprises a housing, which includes an up chamber and a lower chamber. The upper chamber and lower chamber are arranged at two opposite ends of the housing and are substantially parallel to each other. The housing of the steam boiler further includes a group of tubes arranged between the upper chamber and lower chamber. The tubes can be filled with liquids, such as water. The housing of the steam boiler still includes a gas structure arranged on a side of the tube group. The gas structure includes a burner and a gas inlet connected to the burner. The burner is arranged facing the group of tubes. Combustion can be provided through the burner to generate heat so that heat exchange with the liquid in the tubes can be achieved.

In such a configuration of a steam boiler in accordance with the disclosure, the flame or the high-temperature flue gas generated during the combustion can be diffused efficiently towards the tubes of in the group. The air flow within the housing of the steam boiler can help the high-temperature flue gas come into full contact with the surface of the tubes to complete the heat exchange. After such heat exchange, flue gas becomes low-temperature and can flow out of the housing. In this configuration, there is no furnace inside the steam boiler, and the flue gas can flow in a single turn. This also help reduce fire hazard caused by furnace explosion often seen in the conventional boilers.

In some embodiments, the tubes in the steam boiler in accordance with the disclosure may be arranged between the lower and upper chambers to form a cylindrical shape. In some embodiments, the tubes may form one or more concentric rings at a sectional face of the tubes, for example at the end of the upper chamber where the tubes are connected to the upper chamber. In some embodiments, the tubes may be arranged uniformly such that each tube has the same sized spaces to its neighboring tubes. In some embodiments, the tubes may be arranged un-uniformly such that each tube may not have the same sized space to it neighboring tubes. In some embodiments, the tubes may form one or more tube groups within the housing of the steam boiler in accordance with the disclosure. Each group of the tubes may form a cylindrical shape or any other shape.

In some embodiments, the lower chamber comprises one or more liquid inlets to allow liquids to flow into tubes. In some embodiments, the upper chamber may comprise one or more steam outlets to allow steam generated from the heat exchange between the flue gas and the surfaces of the tubes to be further used. In some embodiments, the gas structure is configured such that curve combustion zone is formed around the burner to generate heat. In some embodiments, the upper chamber and/or the lower chambers have a dish-like shape. In those embodiments, the dish-like shape has a flat side and a bulged side; and the tubes are connected to the flat sides of the upper and lower chambers.

This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

The foregoing, together with other features and embodiments, will become more apparent upon referring to the following specification, claims, and accompanying drawings.

DETAILED DESCRIPTION OF THE INVENTION

Figure 1:
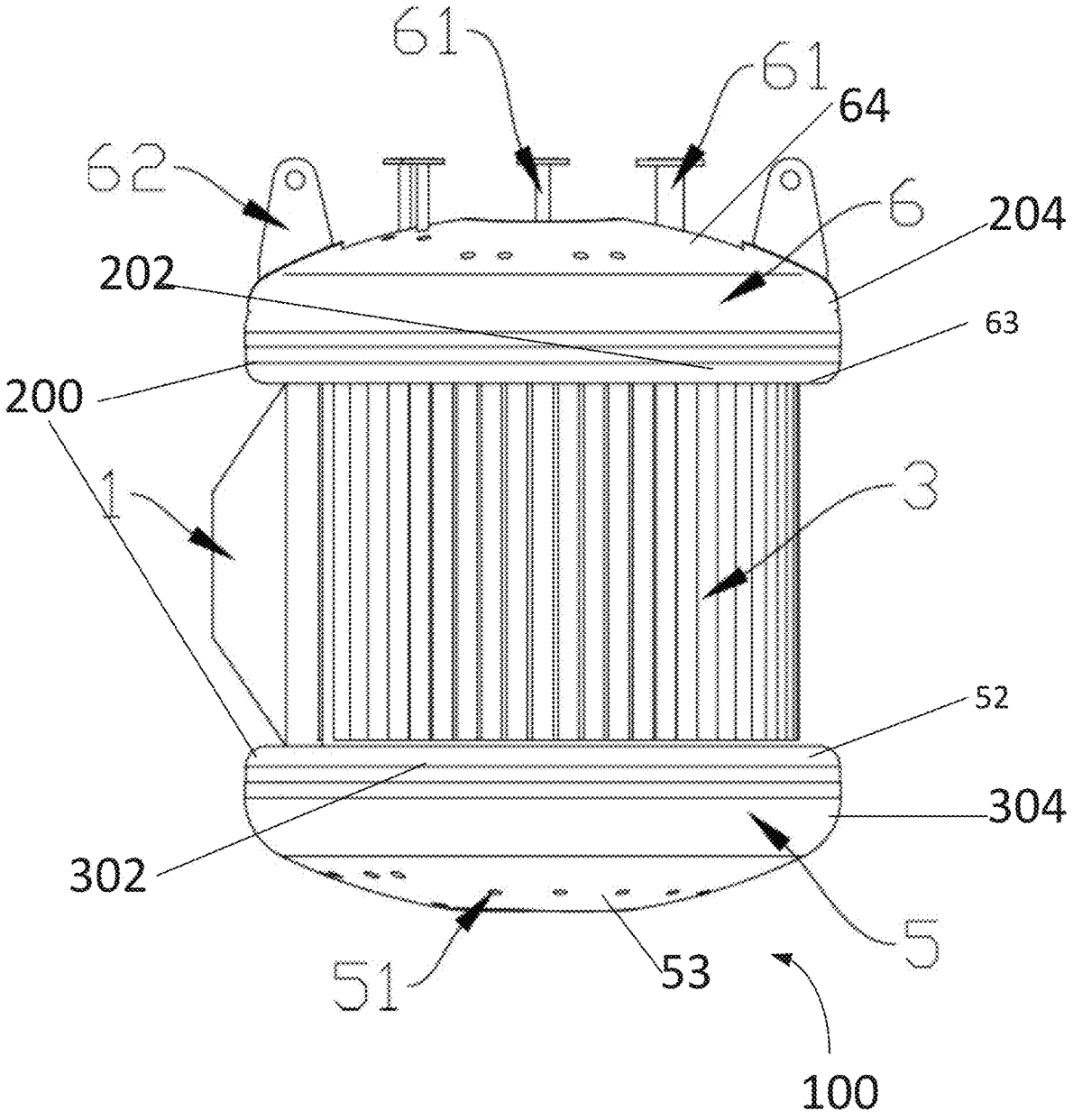
FIG. 1 is a diagram showing a front view of an exemplary steam boiler in accordance with the disclosure.

With reference now to the drawings, and in particular to figures herein, an improved steam boiler system embodying the principles and concepts of the present invention and generally designated by the reference numeral 100 will be described.

Figure 2:
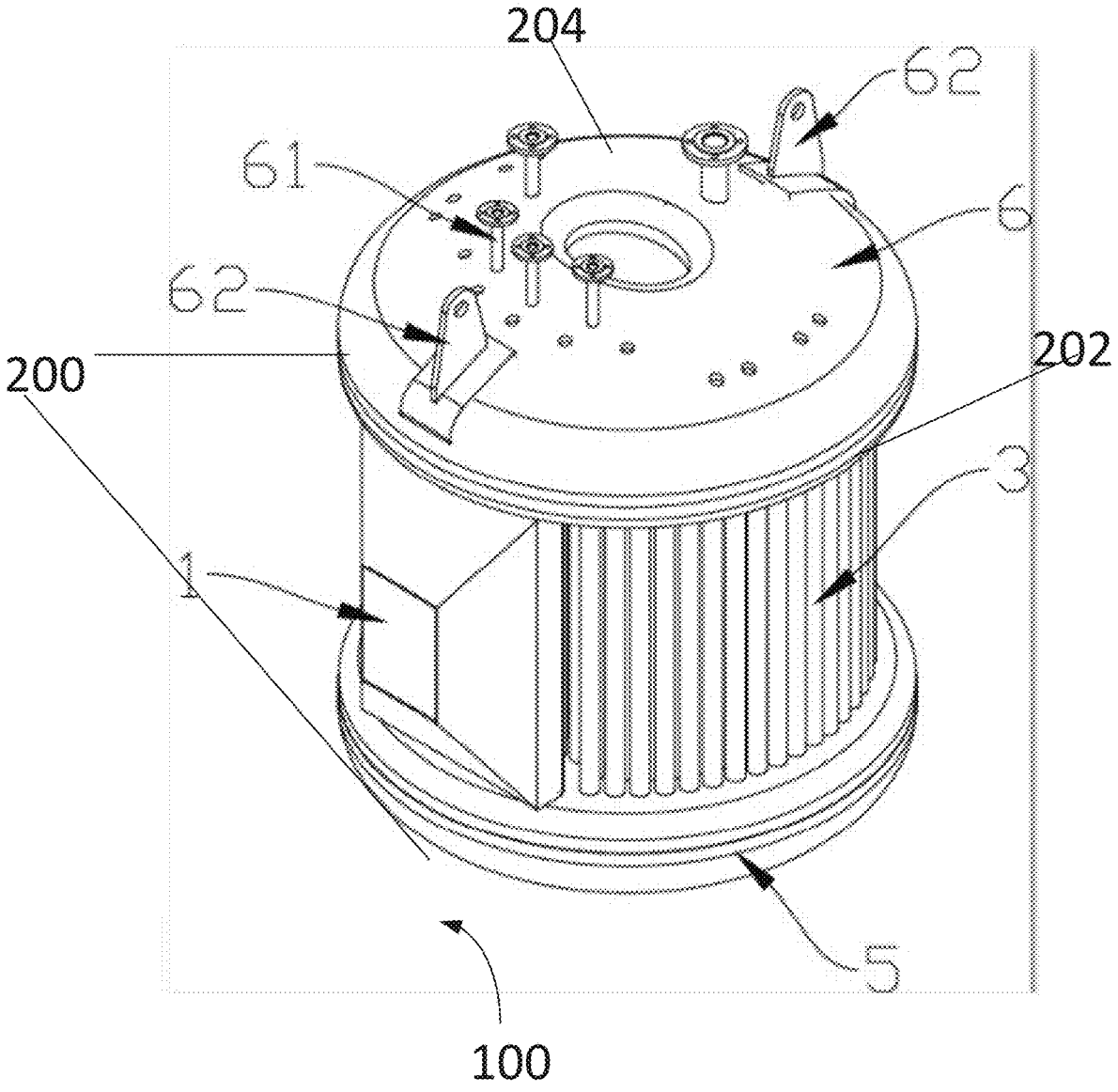
FIG. 2 is a diagram showing a side view of the steam boiler shown in FIG. 1.

As best illustrated in the figures herein, the steam boiler in accordance with the disclosure generally comprises a housing 200. FIG. 1 is a diagram showing a front view of an exemplary a steam boiler 100 in accordance with the disclosure. FIG. 2 is a diagram showing a side view of the steam boiler shown in FIG. 1. As shown FIG. 1 and FIG. 2, the housing 200 can include an upper chamber 6 and a lower chamber 5. As also shown in both figures, the upper chamber 5 and lower chamber 6 can be arranged at two opposite ends of the housing 200 and can be arranged substantially parallel to each other. However, this is not intended to be limiting. It is contemplated that in some embodiments, the upper chamber 6 and the lower chamber 5 may not be parallel to each other.

In some embodiments, as shown in FIG. 1 and FIG. 2, at least one of the lower chamber 5 or the upper chamber 6 can have a dish-like shape. In the embodiment shown in FIG. 1 and FIG. 2, both the lower chamber 5 and the upper chamber 6 have the dish-like shape such that there is a flat side and a bulged side. As shown, the lower chamber 5 has a flat side 52 and a bulged side 53; and the upper chamber has a flat side 63 and a bulged side 64. In this example, the flat sides 52 and 63 face each other, and are substantially parallel to each other. The dish-like shaped upper chamber and/or lower chamber in the steam boiler 100 can increase structural strength of the steam boiler 100 and can simplify manufacturing of the steam boiler 100 compared with traditional steam boiler.

In some embodiments, as shown in FIG. 1 and FIG. 2, the lower chamber 5 can have one or more liquid inlets 51 for allowing liquids, such as water, into tubes 3. In some embodiments, as shown in FIG. 1 and FIG. 2, the upper chamber 6 can have one or more steam outlets 61 for allowing steam, generated from heat exchange within the steam boilers, to escape from the housing 200 and to be further used. However, it should be understood that the liquid inlets 51 and steam outlets 61 are not intended to limit steam boiler in accordance with the disclosure. It is contemplated that in some other embodiments, a steam boiler in accordance with the disclosure may not have the liquid inlets 51 and/or steam outlets 61 as shown in FIG. 1. As still shown in FIG. 1 and FIG. 2, the upper chamber 6 can have a fixing component 62, which can be used to stabilize and fix the housing 200 of the steam boiler 100.

As still shown in FIG. 1 and FIG. 2, the housing 200 of the steam boiler 100 includes a group of tubes 3 that are arranged between the upper chamber 6 and lower chamber 5. As mentioned above, the tubes 3 can be filled with liquids, such as water, from the inlets 51. As shown, the tubes 3, in this example, form a cylindrical shape between the upper chamber 6 and lower chamber 5.

Figure 3:
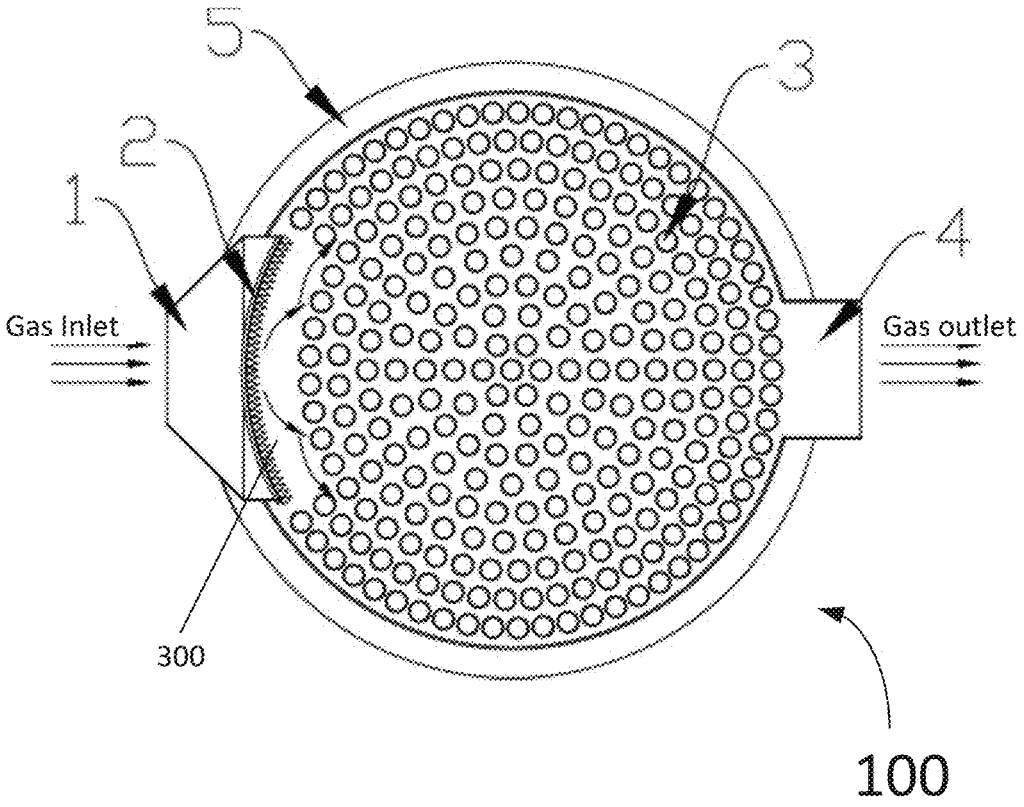
FIG. 3 is a diagram showing an exploded view of the steam boiler shown in FIG. 1.

Also show in FIG. 1 and FIG. 2 is that the steam boiler 100 can include a gas structure 1 arranged on a side of the cylindrical shaped tubes 3. FIG. 3 is a diagram showing an exploded view of the steam boiler shown in FIG. 1. As shown in FIG. 3, in some embodiments, the gas structure 1 can include a burner 2 and a gas inlet connected to the burner. The burner 2 can be arranged facing the tubes 3. Combustion can be provided through the burner 2 to generate heat so that heat exchange with the liquid in the tubes 3 can be achieved. In operation, premixed gas can be introduced into the gas structure 1 from the gas inlet and then burns on the surface of the burner 2 to generate high-temperature flue gas. The generated high-temperature flue gas is then dispersed among the tubes 3 to heat the tubes 3. Through heat exchange, the heat is absorbed by liquids, such as water, in tubes 3. As a result of such heat exchange, the heated water flows upward in the tubes 3 to enter the upper chamber 6 and generate steam in the upper chamber 6 for further use.

As also shown in FIG. 1 and FIG. 2, the upper chamber 6 of the exemplary steam boiler 100 can include a dish head 204 and one or more of a side-bend tube sheet 202. The side-bend tube sheet 202 may be configured to have via holes so that the tubes 3 can be inserted into the side-bend tube sheet 202 through the via holes. The side-bend tube sheet(s) 202 may have a flat sheet and a bent side that can be fit around a circumference of the housing of the steam boiler 100; and the flat sheet may have the aforementioned via holes. As shown, the side-bend tube sheet 202 and dish head 204 are welded together during manufacturing of the steam boiler 100 to form an integral structure. Similarly, the lower chamber 5 of the exemplary steam boiler 100 can include a dish head 304 and one or more of side-bend tube sheets 302. The side-bend tube sheets 203 may be configured to have via holes so that the tubes 3 can be inserted into the flat head 302 through the via holes. In this example, the side-bend tube sheets 302 and dish head 304 are also welded together during manufacturing of the steam boiler 100 to form an integral structure.

In such a configuration shown in FIG. 3, flame is only generated on the surface of the burner 2, and thus the flame is not in direct contact with the tubes 3. In this way, the combustion of the flame is controlled and the combustion is more thorough. U.S. patent application Ser. No. 15/671,124, filed Aug. 7, 2017, entitled "IMPROVED COMBUSTION CHAMBER" describes a grate structure that can be incorporated into various embodiments to facilitate the "flameless" heat exchanger described herein and is incorporated herein by reference. As shown, the combustion zone 300 generated by the burner where the combustion takes place has a curve shape, which can lead to more complete combustion and thereby reduce pockets of areas where combustion is not complete often seen in a traditional steam boiler. This can help reduce NOx generation during combustion and increase combustion efficiency. Such a "flameless" configuration can also improve the service life of the steam boiler 100 since there is no direct burning of the surfaces of the tubes 3.

After being generated by the combustion by the burner, the high-temperature flue gas is dispersed to make contact with the tubes 3. In this configuration, the contact area with the tubes 3 is large and thus increases heat exchange efficiency compared with traditional steam boiler. Such heat exchange efficiency increase can be attributed to the densely arranged tube 3 having spaces with respect to each other so that the high-temperature flue gas can flow through the tubes 3 and make contact with the surfaces of the tubes 3 fully. After the heat exchange with the tubes 3, the flue gas becomes low temperature and flows out of the flue gas outlet 4 as shown. In this configuration, the boiler is a non-hearth design and the flue gas is a single return flow, which reduces the potential safety hazard of the hearth deflagration.

Figure 4A:
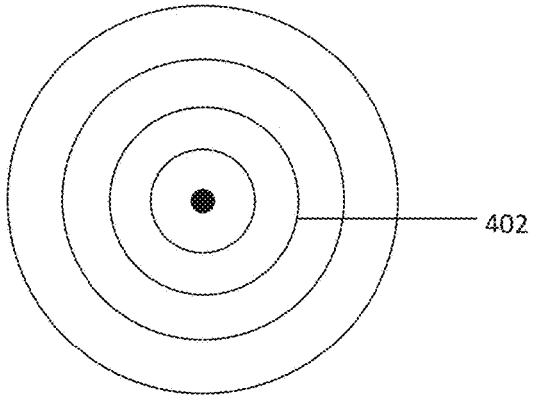
FIG. 4A shows one exemplary arrangement of tubes in an steam boiler in accordance with the disclosure.

In various implementations, for increasing contact area with the high-temperature flue gas and/or heat exchange efficiency, the tubes 3 may be arranged to form one or more concentric rings at a sectional face of the tubes 3. FIG. 4A shows one exemplary arrangement of tubes 3 in concentric rings. As show, the tubes 3 shown in FIGS. 1-3 can be arranged spaced from each other to form concentric rings at one or both end of the tubes (for example at the end where the tubes 3 are connected with the upper chamber 6 and/or lower chamber 5) in some embodiments. In those embodiments, the spaces between each tube 3 may or may not be the same. That is, the tubes 3 may be arranged uniformly to have the same or substantially the same space size to each other and to form concentric rings. However, it should be understood that this is not necessarily the only case. In some other examples, the tubes 3 may be arranged non-uniformly such that the individual tubes 3 can have variable space sizes with each other to form the concentric rings 402.

Figure 4B:
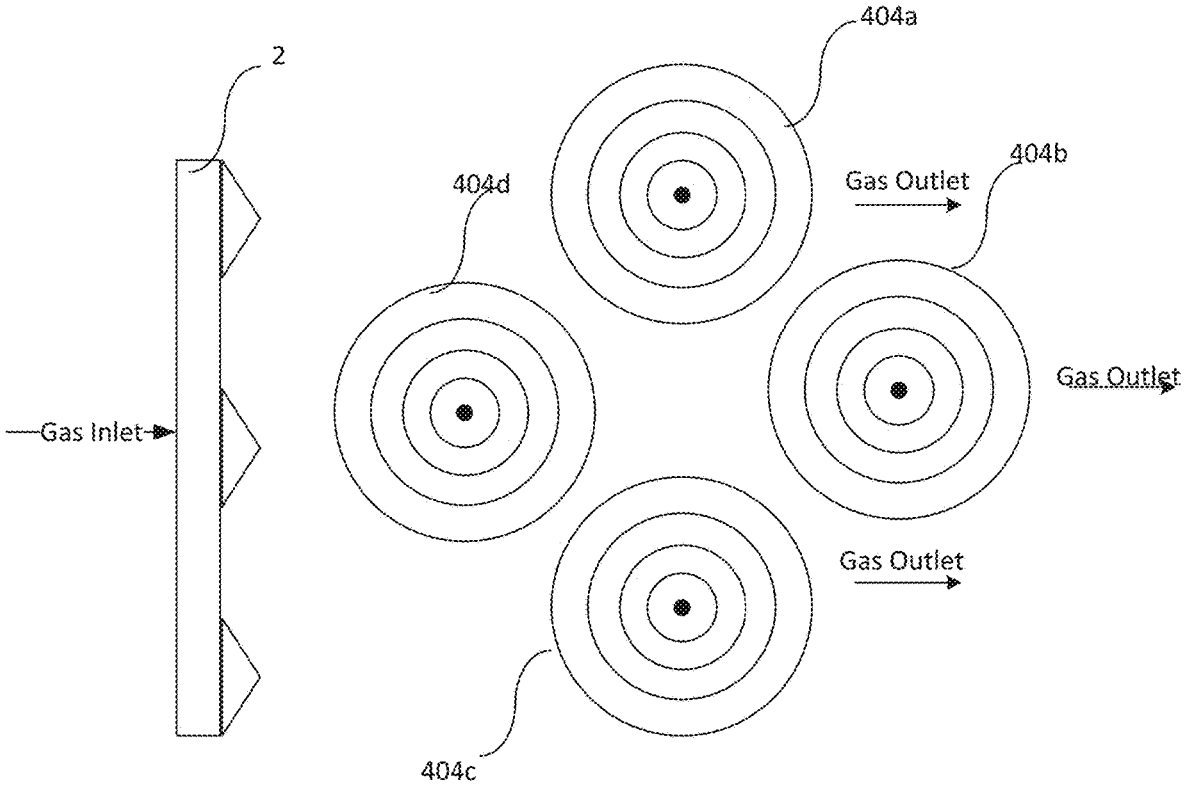
FIG. 4B shows another exemplary arrangement of tubes in an steam boiler in accordance with the disclosure.

FIG. 4B shows another exemplary arrangement of tubes 3 in a steam boiler in accordance with the disclosure. In this example, the tubes 3 can be arranged into tube group 404. Each tube group 404 may have an arrangement of tubes 3 in the group more or less the same as or similar to that shown in FIG. 4A. The tubes 3 in the tube group 404 may or may not have the same spacing arrangement. For example, one or more groups of tubes 404 may be arranged uniformly in terms of spacing and some other group(s) of tubes 404 may be arranged non-uniformly. As shown, the burner 2 can be arranged at one side of the tube groups 404 and the gas outlets can be arranged at the other side of the tube groups 404.

Figure 5A:
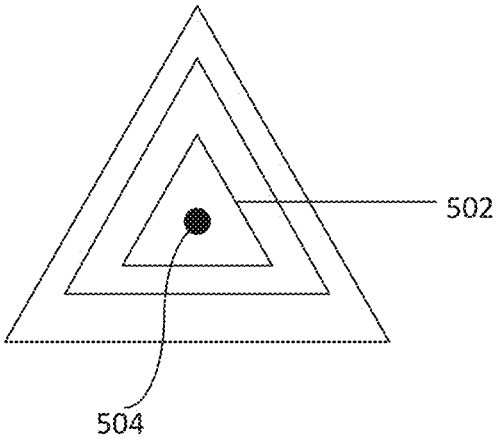
FIG. 5A shows another exemplary arrangement of tubes in an steam boiler in accordance with the disclosure.
Figure 5B:
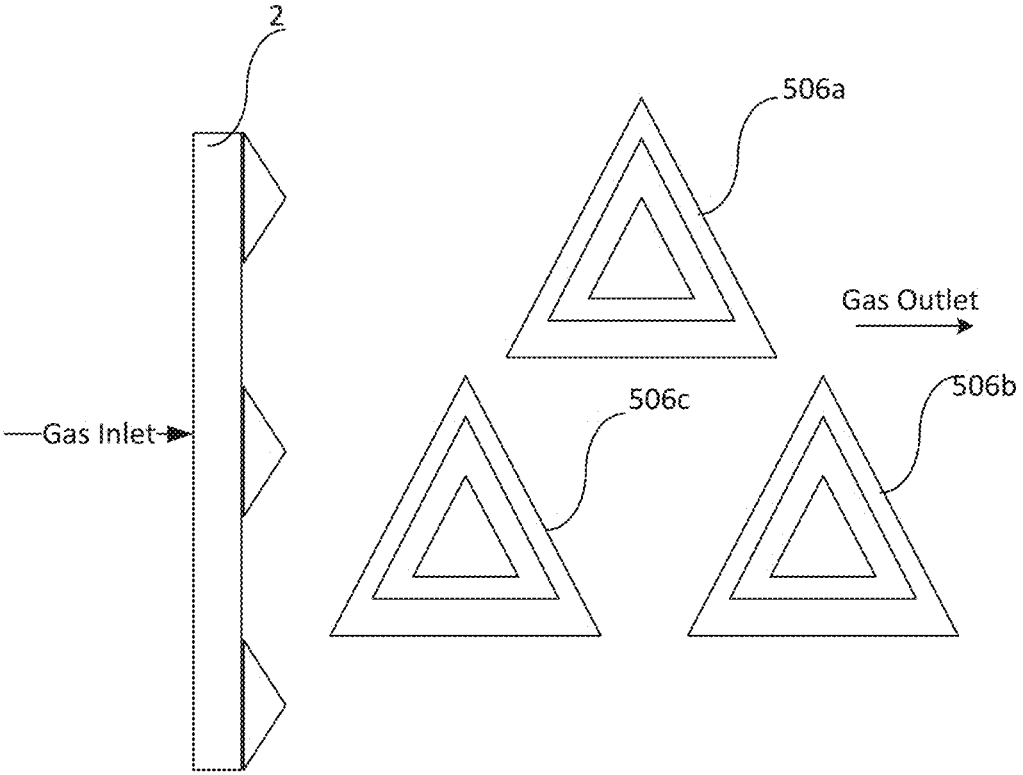
FIG. 5B shows still another exemplary arrangement of tubes in an steam boiler in accordance with the disclosure.

FIG. 5A illustrates another exemplary arrangement of the tubes 3 in a steam boiler in accordance with the disclosure. In this example, as shown, the tubes 3 can be arranged as triangles 502 having a same center 504. FIG. 5B shows another exemplary arrangement of tubes 3 can have multiple tube groups 506, with each having an arrangement more or less the same as or similar to that shown in FIG. 5A.

Figure 6:
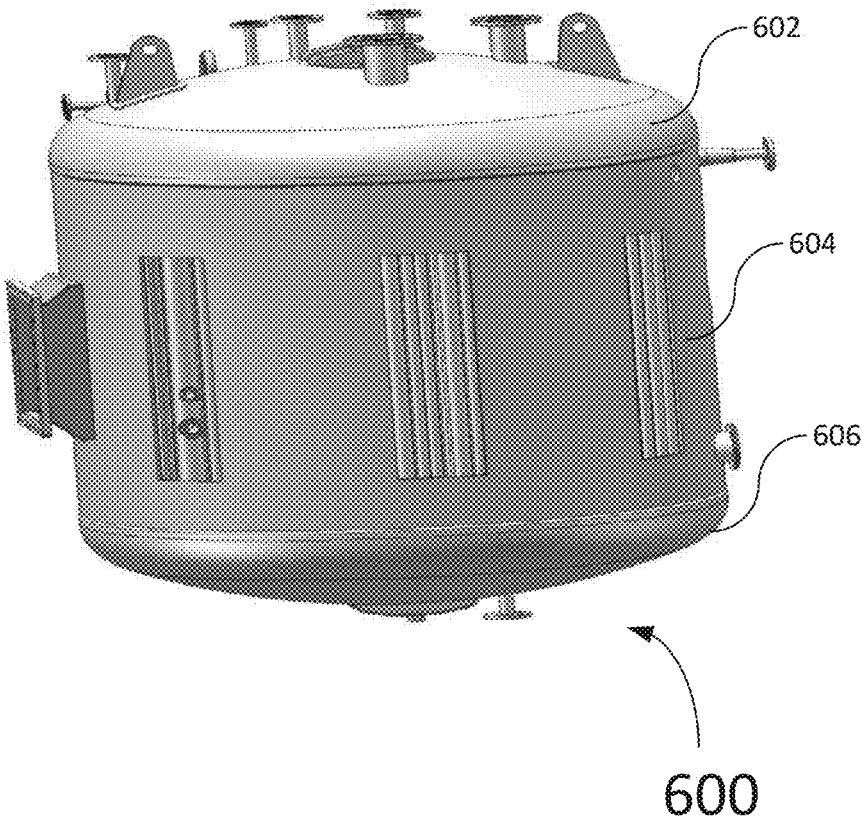
FIG. 6 shows an exterior of another exemplary steam boiler in accordance with the disclosure.

FIG. 6 shows an exterior of another exemplary steam boiler 600 in accordance with the disclosure. Compared with the exemplary boiler 100 shown in FIG. 1 and FIG. 2, the steam boiler 600 has a dish head 602 that is welded to the housing 604 of the steam boiler 600 without a side-bend flat sheet (such as the side-bend tube sheets 202) welded in between the two. Likewise, the bottom dish head 606 of the steam boiler 600 is welded to the housing 604 without a flat head (such as the side-bend tube sheets 302) welded in between the two.

Figure 7:
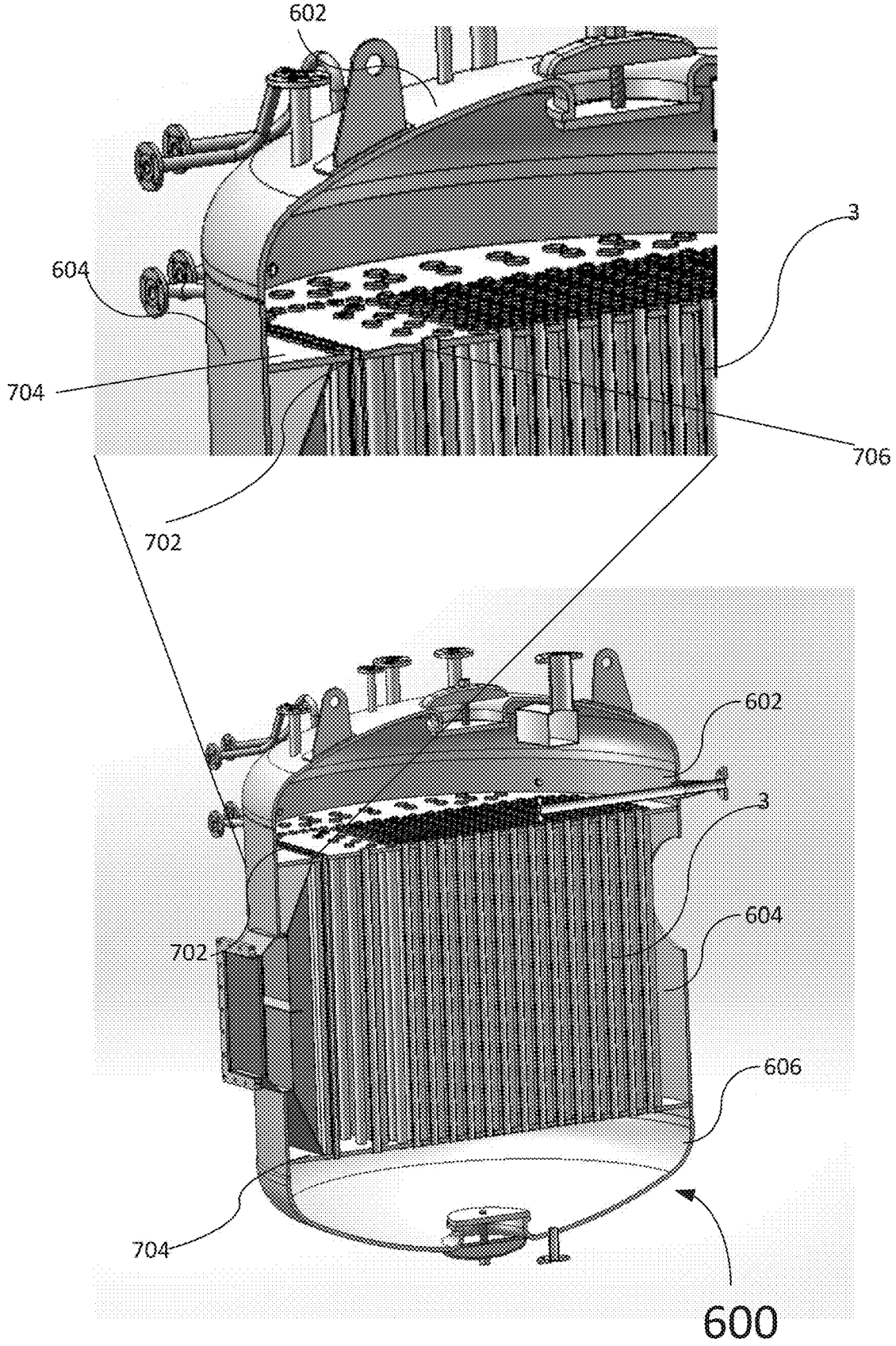
FIG. 7 shows a sectional view of the exemplary steam boiler shown in FIG. 6.

FIG. 7 shows a sectional view of the boiler 600 shown in FIG. 6. As shown, the upper figure in FIG. 7 is an enlarged view of the up left section of the boiler 600. As shown, instead having a flat head shown in the exemplary steam boiler 100 in FIG. 1, the steam boiler 600 has a upper flat tube sheet 702 and bottom flat tube sheet 704 with via holes such that tubes 3 can be inserted into the flat tube sheets 702 and 704 through the via holes. The flat tube sheets 702 and 704 can be welded to the housing 604 of the steam boiler 600, not to the dish heads 602 and 604. In this way, the structure integrity of the steam boiler 600 is improved compared with the steam boiler 100.

The specification and drawings are, accordingly, to be regarded in an illustrative rather than a restrictive sense. It will, however, be evident that additions, subtractions, deletions, and other modifications and changes may be made thereunto without departing from the broader spirit and scope. Illustrative methods and systems for providing features of the present disclosure are described above. Some or all of these systems and methods may, but need not, be implemented at least partially by architectures such as those shown in FIGS. 1-12 above.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

What is claimed is:

1. A boiler comprising a housing, wherein the housing comprises:

an upper chamber and a lower chamber, the upper chamber and lower chamber being on the opposite ends of the housing and being substantially parallel to each other;

an upper flat tube sheet and a lower flat tube sheet, each of the flat tube sheets having via holes;

a tube group arranged between the upper chamber and the lower chamber, the tube group comprising tubes Tillable with liquid; and a gas structure arranged on a side of the tube group, wherein the gas structure reaches bottom of the upper chamber and top of the lower chamber respectively, the gas structure comprises:

a burner arranged facing the tube group; and a gas inlet connected to the burner, the gas inlet being configured to supply gases to the burner, wherein:

the upper chamber and lower chamber each has a dish head;

the tubes in the tube group are inserted into the lower flat tube sheet through the via holes of the lower flat tube sheet and inserted into the upper flat tube sheet through the via holes of the upper flat tube sheet, wherein the lower flat tube sheet and upper flat tube sheet are each one integral sheet extending from one side of the housing to the other side of the housing;

the upper flat tube sheet is welded to the housing of the boiler and is not welded to the dish head of the upper chamber;

the lower flat tube sheet is welded to the housing of the boiler and is not welded to the dish head of the lower chamber; and the tubes in the tube group are arranged in parallel to each other between the upper and lower chambers.

2. The boiler of claim 1, wherein the tubes in the tube group are arranged between the upper and lower chambers such that they form a cylindrical shape.

3. The boiler of claim 1, wherein the tubes in the tube group are arranged between the upper and lower chambers to form one or more concentric rings.

4. The boiler of claim 1, wherein the tubes in the tube group are arranged between the upper and lower chambers uniformly.

5. The boiler of claim 1, wherein the tubes in the tube group are arranged between the upper and lower chambers non-uniformly.

6. The boiler of claim 1, wherein the lower chamber comprises one or more liquid inlets and the upper chamber comprises one or more steam outlets.

7. The boiler of claim 1, wherein the gas structure is configured such that a curve combustion zone is formed around the burner for generating heat.

8. The boiler of claim 1, wherein the upper chamber comprises one or more components for stabilizing and fixing the housing.

9. The boiler of claim 1, wherein the upper tube sheet comprises a flat panel and a bent side configured to be fit around a circumference of the housing of the steam boiler.

* * * * *